US006300636B1

(12) United States Patent
Shih et al.

(10) Patent No.: US 6,300,636 B1
(45) Date of Patent: Oct. 9, 2001

(54) ION SOURCE HEAD

(75) Inventors: Kuo-Pin Shih, Nantou; Wen-Lung Ho, Chungho, both of (TW)

(73) Assignee: Taiwan Semiconductor Manufacturing Company, Ltd., Hsin Chu (TW)

( * ) Notice: Subject to any disclaimer, the term of this patent is extended or adjusted under 35 U.S.C. 154(b) by 0 days.

(21) Appl. No.: 09/410,899

(22) Filed: Oct. 2, 1999

(51) Int. Cl.[7] ..... H01J 27/00

(52) U.S. Cl. ..... 250/426; 250/427; 250/423 R; 250/310; 250/311

(58) Field of Search ..... 250/426, 427

(56) References Cited

U.S. PATENT DOCUMENTS 5,886,355 * 3/1999 Bright et al. ..... 27/8

* cited by examiner

*Primary Examiner*—Jack Berman
*Assistant Examiner*—Kalimah Fernandez
(74) *Attorney, Agent, or Firm*—Tung & Associates

(57) ABSTRACT

An improved ion source head for use with an ion implantation machine includes an arc chamber within which a heated filament creates an ion plasma from a source gas. The source gas is introduced into the chamber evenly through at least four, but preferably six through hole openings in a bottom liner in the chamber. Even distribution of the gas entering the chamber reduces build-up and flaking of material in the chamber that can result in short circuits.

20 Claims, 3 Drawing Sheets

ION SOURCE HEAD

TECHNICAL FIELD

The present invention generally relates to ion implantation machines used in fabricating semiconductor devices, and deals more particularly with an improved ion source head that reduces material build-up and flaking in the arc chamber.

BACKGROUND OF THE INVENTION

Semiconductor fabrication processes often use a high current ion implantation machine to implant impurity ions into semiconductor substrates in order to form doped regions, such as sources and drains. The ion implanter delivers a beam of ions of a particular type and energy to the surface of a silicon substrate. Such machines typically include an ion source supply, normally a gas source, and an ion source power supply which is connected to an ion source head. A small quantity of the gas is passed through a vaporizer oven and then into an arc chamber which includes a heated filament, and an anti-cathode. The filament is directly heated by passing electric current through it, derived from the power supply. This heating causes thermionic emission of electrons from the surface of the filament. An electric field, typically 30 to 150 volts is applied between the filament and the arc chamber walls using the power supply. The field accelerates the electrons in the filament area to the arc chamber walls. A magnetic field is then introduced to perpendicular to the electric field and causes the electrons to spiral outward, increasing the path length and chances for collisions with the gas molecules. The collisions break apart many of the molecules and ionize the resultant atoms and molecules by knocking outer shell electrons out of place. As charged particles, these atomic or molecular ions can now be controlled by magnetic and/or electric fields. Source magnets are employed to change the ion path from a straight path to a helicoid path. With one or more electrons missing, the particles carry a net positive charge. An extraction electrode (anti-cathode) placed in proximity to a slit and held at a negative potential attracts and accelerates the charged particles out of the chamber through the slit opening in the top of the chamber. Ions exiting the chamber are passed through an acceleration tube where they are accelerated to the implantation energy as they move from high voltage to ground. The accelerated ions form a beam well collimated by a set of apertures. The ion beam is then scattered over the surface of a wafer using electrostatic deflection plates.

After operation over a period of time, the processing of gasses in the arc chamber results in the accumulation of materials deposited from the gas, causing the formation of a conductive coating on the filament, chamber walls and anti-cathode. This coating eventually flakes, causing the filament to short out such that its can no longer produce electrons and the implantation machine becomes inoperable. This shorting phenomena is a result of arc-outs and typically occurs during boron implanting. When the arc chamber shorts out, it is necessary to clean the chamber, the anti-cathode and filament, which is a time consuming procedure since the machine is operated at a high vacuum pressure. This procedure is not only time consuming and costly, but the machine down time reduces throughput.

Accordingly, there is a clear need in the art to provide an improved arc chamber that reduces or eliminates arcing and shorting within the arc chamber.

SUMMARY OF THE INVENTION

In accordance with the present invention, an improved ion source head is provided for use in an ion implantation machine comprising an arc chamber, a source of gas, arc means for generating an ion plasma within the chamber, and a bottom liner in the chamber having the plurality of spaced apart through holes therein for allowing the evenly distributed introduction of gas into the chamber, thus tending to avoid concentrated material buildup or coating on elements within the chamber. The bottom liner includes at least four, but preferably six thru-holes therein communicating with a feed chamber beneath the bottom liner which is coupled with the gas source. Each of the through-holes is preferably greater than 4 mm but less than 8 mm in diameter. The through-holes are desirably arranged in two groups thereof respectively lying along parallel axes, and thus are disposed symmetrically in a bottom of the arc chamber.

According to another aspect of the invention, an ion source is provided for generating ions, comprising: and arc chamber defined by a top, a bottom, opposing sides and opposing ends; a source of ions in the form of a selected gas; a heated filament on one of the chamber ends; and an anti-cathode on the other of the chamber ends; and a plurality of openings in the bottom of the chamber coupled with the gas source and allowing evenly distributed introduction of gas into the chamber between the filament and the anti-cathode.

Accordingly, it is a primary object to provide an improved ion source head which reduces arcing and shorting within the arc chamber caused by coating build-up on elements within the chamber.

Another object of the invention is to provide an improved ion source head of the type described above which reduces down time necessary for cleaning the arc chamber.

A still further object of the invention is to provide an improved ion source head of the type described above which allows for the even distribution of an ion source gas flowing into the arc chamber.

Another object of the invention is to provide an improved ion source head which significantly reduces coating and flaking of ion source materials on the anti-cathode, and undesired arcing which results from such flaking.

These, and further objects and advantages of the invention will be made clear or will become apparent during the course of the following description of a preferred embodiment of the invention.

BRIEF DESCRIPTION OF THE DRAWINGS

In the drawings which form an integral part of the specification, and are to be read in conjunction therewith, and in which like reference numerals are employed to designate identical components in the various views.

DESCRIPTION OF THE PREFERRED EMBODIMENT

Figure 1:
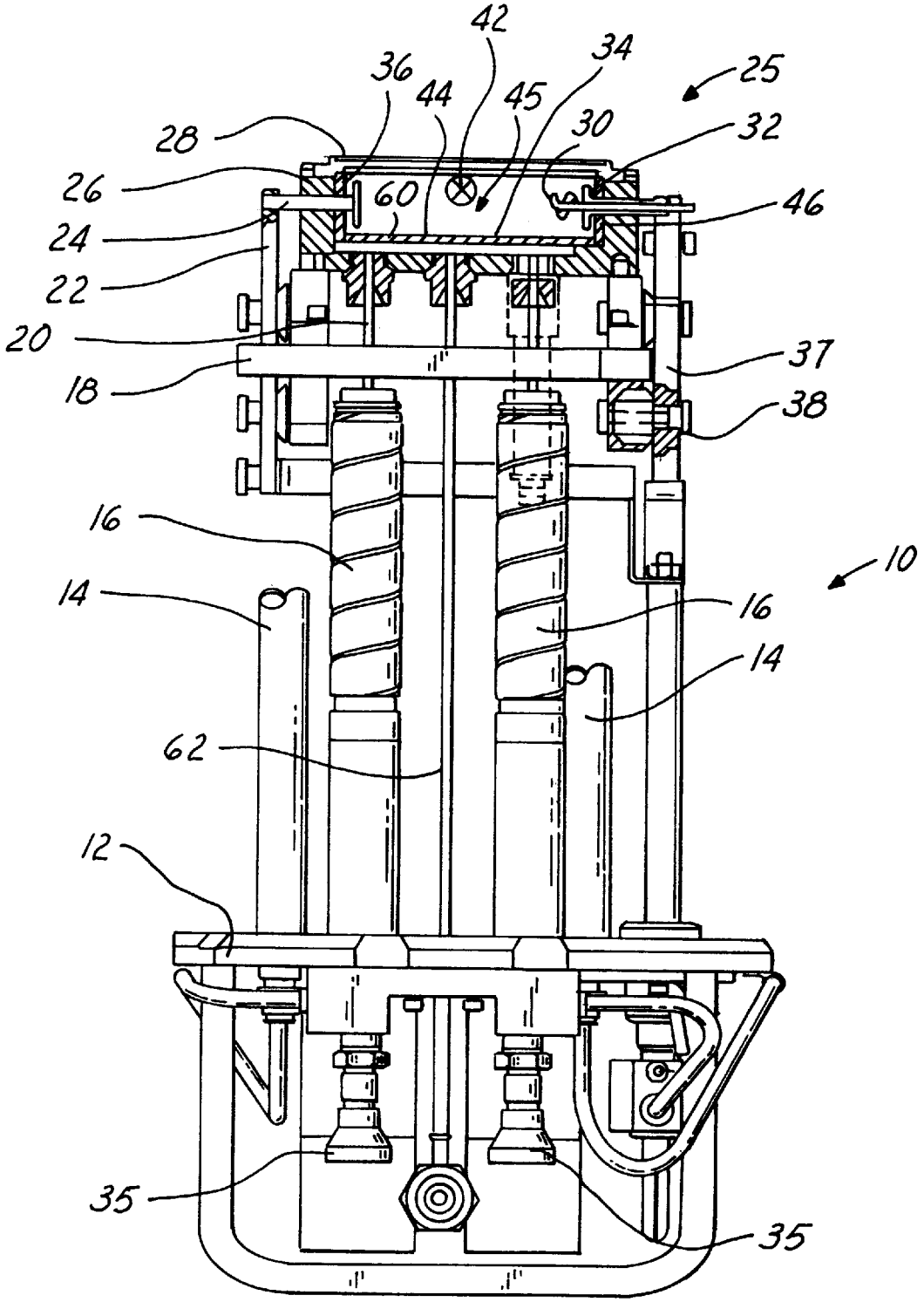
(PRIOR ART) FIG. 1
FIG. 1 is a side view of an ion implantation machine, parts being broken away in section, and showing a prior art source head.
Figure 2:
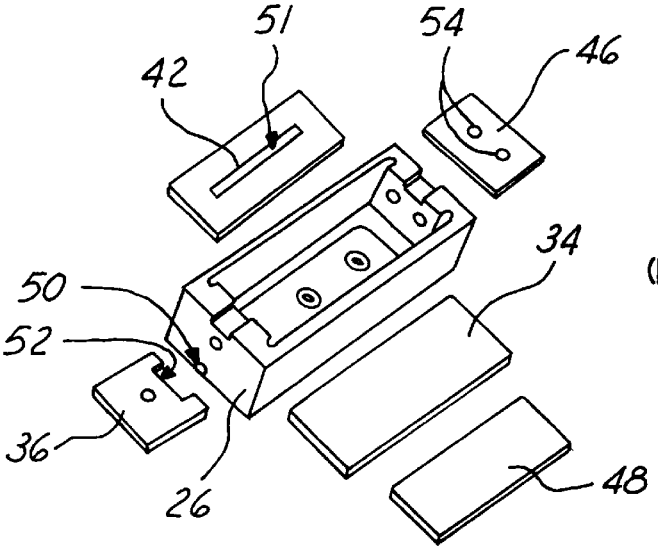
(PRIOR ART) FIG. 2
FIG. 2 is an exploded, perspective view of the arc chamber body and liner components.
Figure 3:
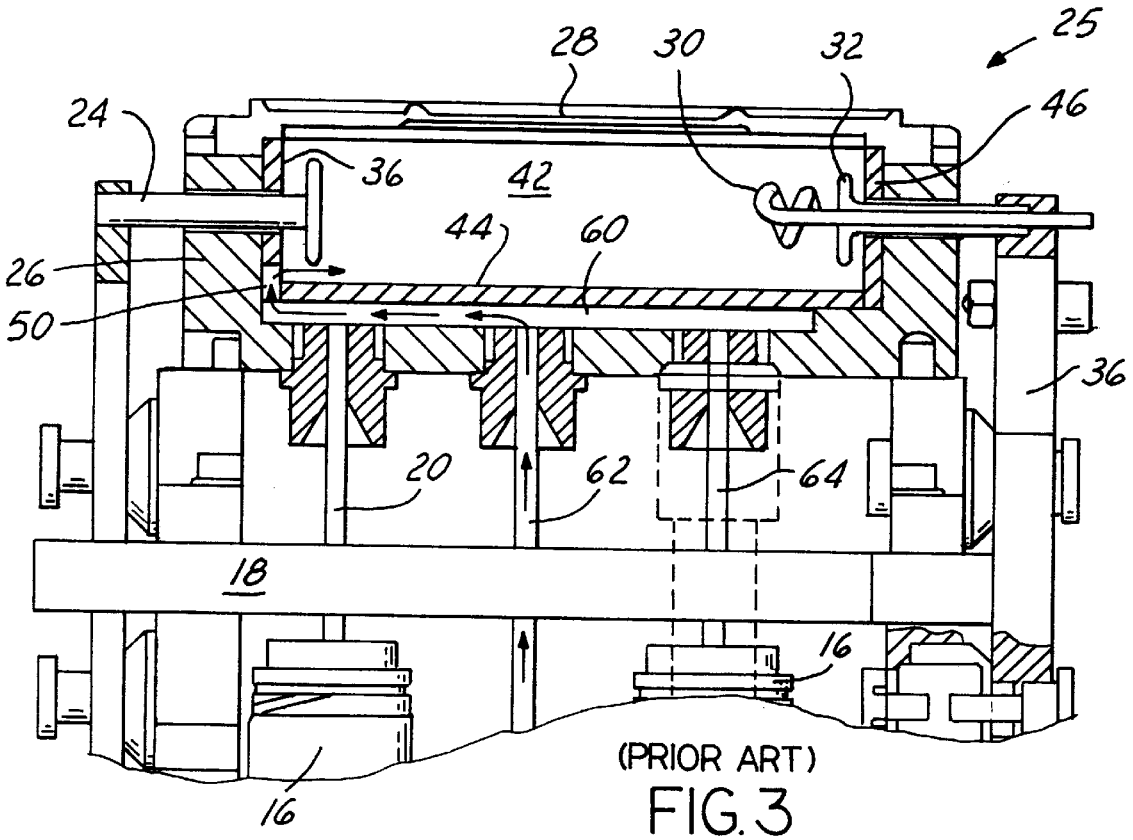
(PRIOR ART) FIG. 3
FIG. 3 is an enlarged, fragmented view of the prior art source head shown in FIG. 1.

Referring first to FIGS. 1–3, a conventional prior art ion source head, generally indicated with the numeral 10, is employed as part of a conventional high current ion implantation machine. The ion source head 10 broadly includes a rigid body 12, and two or more elongated legs 14 supporting an ion head assembly that includes a cooled plate 18 and an arc chamber assembly 25. A pre-selected gas which provides the source of ions is supplied to the arc chamber 25 by supply lines 20, 62 and 64 that respectively terminate in nozzles communicating with a feed chamber 60. One of the above-mentioned designated by the numeral 42. The supplied gas may be any of a number of types, depending upon the particular application, such as boron, antimony, or other known gasses used in ion implantation processes. Ovens 16 surrounding at least certain of the tubes 20, 64 may be provided for heating the supplied gasses. The ovens 16 are cooled by cooling water introduced into jacket surround the ovens 16 through quick connect fittings 35. The arc chamber assembly 25 includes an arc chamber body 26 provided with a central, generally rectangular arc chamber 45 having a liner consisting of a pair of opposed side walls 42, 48, a pair of opposing end walls 36, 46 and a top wall 34 having an elongate slit 51 (FIG. 2) therein through which ions may escape.

An anti-cathode 24 extends through an aperture in the liner end 36 at one wall of the liner 28 and is held in place by a clamp 22. An electrical filament 30 also extends into the chamber 45 and includes a pair of legs which pass through a pair of apertures 54 in the and the other liner end 46, and corresponding through-holes in the opposite end of the chamber body 28. The filament 30 is held in place by a filament clamp 37 which is adjustable by means of a adjustment assembly including a thumb screw 38. Filament 30 is provided with a electron reflector 32 which extends into the chamber 45 and assists in reflecting electrons away from the filament 30. As best seen in FIGS. 1 and 3, the bottom wall of the body 26 includes a recessed area that defines the supply chamber 60, immediately beneath the liner bottom 44. The liner end 36 includes a generally rectangular opening 50 along the bottom edge thereof which communicates with the supply chamber 60.

Accordingly, gas supplied through any one of the lines 20, 62, 64 passes into the supply chamber 60, and thence through opening 50 into the interior of the chamber 45. This gas flow arrangement results in a concentration of the freshly supplied gas in one end of the chamber 45, adjacent the anti-cathode 24. As a result of this gas concentration, there is a tendency for parts of the chamber assembly 25, but particularly the anti-cathode 24 to become heavily coated with material which is an electrically conductive precipitant of the supplied gas. This coating eventually flakes, and the flaked coating causes an electrical short within the chamber 45.

As previously discussed, the electrical filament 30 is coupled with a suitable power supply source which heats the element 30 and causes the thermionic emission of electrons from the surface of the filament 30. An electric field, typically 150 volts, is applied between the filament 30 and the liner walls which are electrically conductive, using the power supply. This field accelerates electrons from the area of the filament 30 to the liner walls. A magnetic field is introduced perpendicular to the electric field and causes the electrons to spiral outward increasing the path thereof and chances for collisions with the molecules of the gas introduced into the chamber 45. These collisions break apart many of the molecules and ionize the resultant atoms and molecules by knocking outer shell electrons out of place. As charged particles, these atomic or molecular ions can then be controlled by magnetic and/or electric fields, and using magnets or the like, these charged particles, which have a positive charge, are attracted by the anti-cathode 24 so that the charged particles are accelerated out of the chamber 45 through the slit 51 in the top wall 34.

Figure 4:
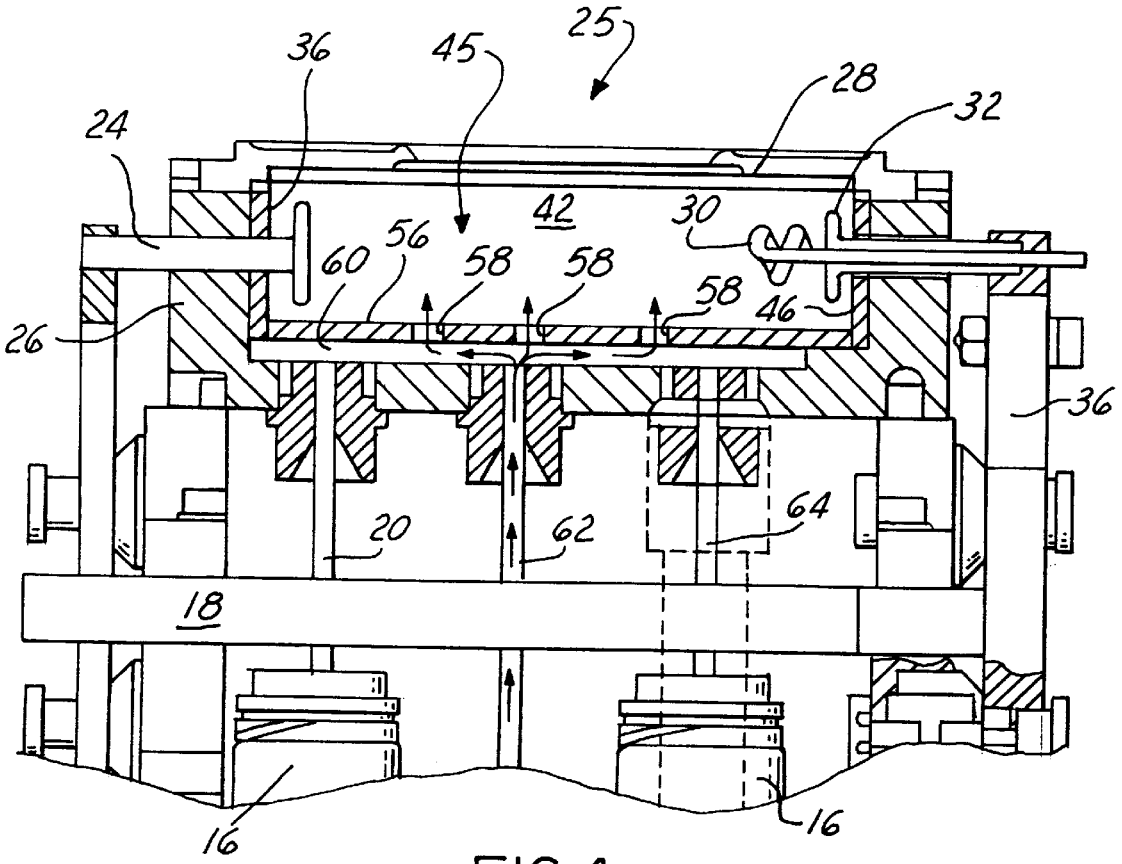
FIG. 4 is a view similar to FIG. 3 but depicting the improved ion source head of the present invention.
Figure 5:
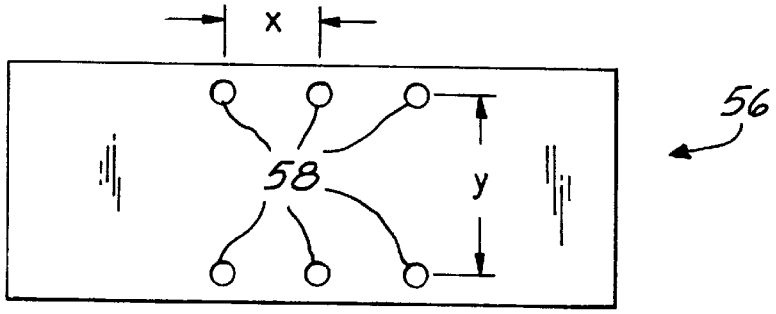
FIG. 5 is a plan view of the bottom liner that forms part of the head shown in FIG. 4.
Figure 6:
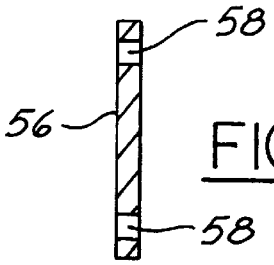
FIG. 6 is an end view of the bottom liner shown in FIG. 5.

Referring now also to FIGS. 4–6, it has been discovered that by changing the path of the flow of gas into the chamber 45, concentration of the coating build-up on the interior of the chamber 45 are reduced, in turn reducing the probability of flaking and resultant short circuits. In accordance with the present invention, the opening 52 in the prior art liner end 36 (FIG. 2) is eliminated, and the liner bottom 48 is provided with a plurality of through holes 58. At least four of such through holes 58 should be provided, although six holes has been found to be most desirable.

The through holes 58 are arranged in two groups of three holes each, respectively aligned along two parallel axes to form a symmetrical, grid pattern in order to uniformly distribute gas flowing into the chamber 45. The diameter of each of the through holes 58 is preferably greater than 4 mm, but less than 8 mm, although the exact diameter will vary depending on the total number of through holes 58 and their relative spacing. In the preferred embodiment of the invention, the spacing between the centers of the through holes 58 and each group thereof is approximately 15 mm (dimension "x" in FIG. 5) and the spacing between the center lines of the through holes 58 and the two groups is approximately 30 mm (dimension "y" in FIG. 5).

Surprisingly, it has been found that the improved arrangement for supplying gas into the arc chamber 45 as described above can increase the life of the ion source head 10 by 20%, while significantly reducing down time caused by equipment failure due to shorting.

From the foregoing, it is apparent that the present invention not only provides for the reliable accomplishment of the objects of the invention but does so in a peculiarly efficient and economical manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. For use in an ion implantation machine, an improved ion source head, comprising:

an arc chamber;

a source of gas;

arc means for generating an ion plasma in said chamber using said gas; and, a bottom liner in said chamber, said liner including a plurality of spaced apart through holes therein coupled with said gas source for allowing the introduction of said gas into said chamber.

2. The ion source head of claim 1, wherein said bottom liner includes at least four of said through holes therein.

3. The ion source head of claim 1, wherein said through holes are symmetrically spaced with respect to each.

4. The ion source head of claim 1, wherein said bottom liner includes six of said through holes therein.

5. The ion source head of claim 1, including a feed chamber beneath and essentially coextensive with said bottom liner, said gas being supplied from said source through said feed chamber into said through holes.

6. The ion source head of claim 1, wherein said through holes are generally symmetrically spaced about the center of said bottom liner so as to evenly distribute the gas flowing from said source into said chamber.

7. The ion source head of claim 1, wherein each of said through holes possesses a diameter greater than 4 mm.

8. The ion source head of claim 7, wherein each of said through holes possesses a diameter less than 8 mm.

9. The ion source head of claim 1, wherein said plurality of through holes includes first and second groups thereof respectively disposed along first and second axes.

10. The ion source head of claim 9, wherein said axes extend essentially parallel to each other.

11. The ion source head of claim 1, including a pair of side liners in said chamber and a pair of end liners in said chamber, and said chamber includes a top having an opening therein through which ions exit from said chamber, and wherein said through holes define the only openings through which said gas enters said chamber.

12. The ion source head of claim 1, wherein said plurality of said through holes includes first and second groups thereof, and adjacent ones of said through holes in each group thereof are spaced apart from each other a distance of approximately 15 mm.

13. An ion source head for generating ions, comprising:

an arc chamber defined by a top, a bottom, opposing sides and opposing ends;

a source of ions in the form of a gas;

a heated filament on one of said ends;

an anti-cathode on the other of said ends, said filament and said anti-cathode cooperating to produce and distribute an ion plasma in said chamber using said gas; and, a plurality of openings in said bottom of said chamber, said openings being coupled with said gas source and allowing evenly distributed introduction of said gas into said chamber between said filament and said anti-cathode.

14. The ion source head of claim 13, wherein said bottom includes a bottom wall liner, and said openings are defined in said liner.

15. The ion source head of claim 14, including a feed chamber beneath said liner for receiving gas from said gas source and distributing said gas to said openings.

16. The ion source head of claim 13, wherein said bottom includes at least 4 of said openings therein.

17. The ion source head of claim 13, wherein said bottom includes at least 6 of said openings therein.

18. The ion source head of claim 13, wherein each of said openings possesses a diameter greater than 4 mm and less than 8 mm.

19. The ion source head of claim 13, wherein said openings in said bottom are the sole areas at which said gas enters said chamber.

20. The ion source head of claim 13, wherein said openings are arranged in first and second groups thereof respectively lying along first and second generally parallel axes.

* * * * *